US005335776A

United States Patent [19]

Backhaus

[11] Patent Number: 5,335,776

[45] Date of Patent: Aug. 9, 1994

[54] ASSEMBLY FOR INDEPENDENTLY TRANSPORTING YARN PACKAGES HAVING PATH DIVERTING CAPABILITY

[75] Inventor: Jürgen Backhaus, Wegberg, Fed. Rep. of Germany

[73] Assignee: W. Schlafhorst AG & Co., Monchen-Gladbach, Fed. Rep. of Germany

[21] Appl. No.: 996,178

[22] Filed: Dec. 23, 1992

[30] Foreign Application Priority Data

Dec. 23, 1991 [DE] Fed. Rep. of Germany ..... 4142790

[51] Int. Cl.[5] ..... B65G 29/00

[52] U.S. Cl. ..... 198/368; 198/465.1; 242/35.5 A

[58] Field of Search ..... 198/368, 465.1, 465.2; 242/35.5 A

[56] References Cited

U.S. PATENT DOCUMENTS 5,078,329 1/1992 Grechsch et al. ..... 242/35.5 A
5,190,136 3/1993 Grecksch et al. ..... 198/465.1 X
5,205,396 4/1993 Grecksch et al. ..... 198/465.1
5,247,788 9/1993 Bertrams et al. ..... 198/465.1 X

FOREIGN PATENT DOCUMENTS

0402703A1 5/1990 European Pat. Off. .
3416387A1 11/1984 Fed. Rep. of Germany .
3448097C2 1/1988 Fed. Rep. of Germany .
3843554A1 6/1990 Fed. Rep. of Germany .
4011220A1 10/1991 Fed. Rep. of Germany .

*Primary Examiner*—Cheryl L. Gastineau
*Attorney, Agent, or Firm*—Shefte, Pinckney & Sawyer

[57] ABSTRACT

The present invention provides an assembly for transporting tube support members which each individually support a textile yarn package in an upright disposition thereon. The transporting assembly includes a cyclicly reversing endless belt which transports tube support members to and between a plurality of individual transport paths which each lead through a respective winding station of a textile winding machine. The individual transport paths each comprise a pair of endless belts which automatically draw tube support members onto the individual transport paths from the delivery path when the tube support members are disposed on the delivery path at the transport path at a predetermined height relative to the individual transport path. To selectively prevent the entry of tube support members into an individual transport path, the transporting assembly includes a device which selectively increases the relative height of the delivery path with respect to the transport path such that the tube support members travel on the delivery path past the transport path without engagement by the pair of endless belts of the individual transport path.

11 Claims, 6 Drawing Sheets

I
II
III
IV
1
2
3
4
5
6
6'
7
8
9
9'
9''
10
11
12
13
14
15
16
17
18
19
20
21
22

FIG. 5
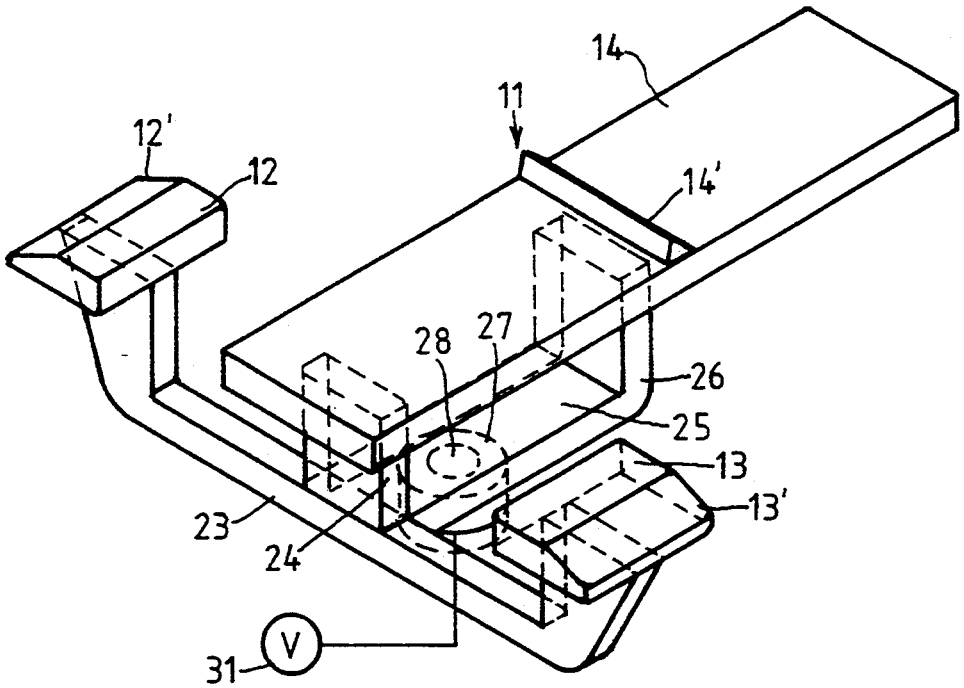
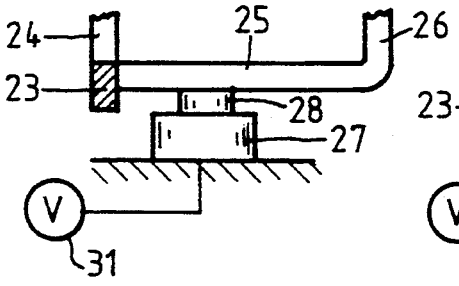
FIG. 6
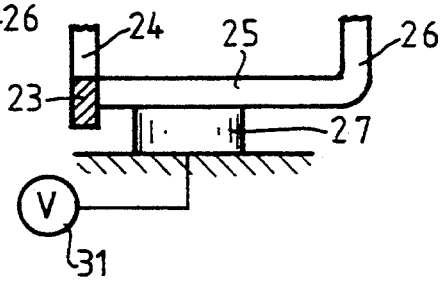
FIG. 7

ASSEMBLY FOR INDEPENDENTLY TRANSPORTING YARN PACKAGES HAVING PATH DIVERTING CAPABILITY

BACKGROUND OF THE INVENTION

The present invention relates to an assembly for transporting yarn packages having automatic path diverting capability and, more particularly, to an assembly for transporting yarn packages individually supported on tube support members and having the capability of selectively automatically diverting tube support members from one path onto another path.

In several known transport arrangements for transporting yarn packages in association with textile machines, the yarn packages are individually supported on tube support members which provide the flexibility to independently handle each yarn package separately from the other yarn packages. German Patent Document DE 40 16 465A1 discloses an improvement in this type of yarn package transport arrangement. The document discloses an endless belt which cyclicly reverses its direction of travel to continuously transport tube support members with yarn packages thereon past the entrance ends of a plurality of branch or spur transport paths which each transport yarn packages to a winding station of a textile winding machine. These branch transport paths each include endless belts whose top runs extend sufficiently into the transport path of the yarn packages being transported by the cyclicly reversing endless member that the tube support members are automatically drawn into the individual branch paths if space is available to receive the tube support members.

Since the individual branch paths extending through each textile winding station automatically draw the tube support members therein, some accommodation must be provided to prevent additional tube support members from entering an individual branch path without, however, interfering with the cyclicly reversing operation of the endless member which transports the tube support members past the entry ends of the individual branch transport paths. One known solution is to dimension each individual branch transport path such that, when a full complement of tube support members have been received in the reserve position of the path, the lastmost one of the tube support members in the reserve position prevents the entry of those tube support members still being cyclicly reversibly transported by the cyclicly reversing endless member, without extending so far into the path of the still to be delivered tube support member as to impede their back and forth movement. However, this known arrangement does not provide adequate flexibility reconfiguring an individual branch path to hold more or fewer tube support members in its reserve locations since only a single predetermined number of tube support members can be accommodated in the reserve location. Accordingly, improvements are desirable in assemblies for transporting yarn packages along and around a textile winding machine.

SUMMARY OF THE INVENTION

Briefly described, the present invention provides an assembly for transporting tube support members, each tube support member having a base and a support portion thereon for supporting a textile tube in a generally upright disposition for transport and handling of the textile tube independent of other textile tubes. The assembly includes means forming a delivery path for transport therealong of tube support members, and means forming a transport path extending transversely from said delivery path at a transfer location for receiving tube support members from the delivery path. The transport path means and the delivery path means are operable in coordination with one another to transfer tube support members from the delivery path to the transport path at the transfer location when tube support members arriving thereat are supported on the delivery path at a predetermined height relative to the transport path. The assembly also includes means for selectively increasing the relative height of the delivery path at the transfer location such that tube support members arriving at the transfer location on the delivery path continue along the delivery path without transfer onto the transport path.

According to preferred aspects of the assembly, an upstream end of the transport path extends to one lateral side of the delivery path, the delivery path means supports tube support members at the transfer location with a portion of the underside of the base of each tube support member exposed toward the one lateral side of the delivery path, and the delivery path means supports tube support members arriving at the transfer location at a height relative to the height of the transport path such that the base underside of the tube support members are engaged by the transport path means and drawn thereonto. Also, the means for selectively increasing the relative height of the delivery path includes means for selectively raising the delivery path or lowering the transport path at the transfer location to prevent engagement of the base underside of tube support members by the transport path.

According to other preferred aspects of the assembly, the transport path means includes at least one endless member having a top run traveling in a direction laterally away from the transfer location and positioned for engaging the base undersides of tube support members to thereby draw the tube support members from the delivery path onto the transport path. Additionally, the means for selectively increasing the relative height of the delivery path includes means forming a cross-over surface in communication with the delivery path for supporting tube support members above the endless member to thereby allow travel of the tube support members on the delivery path downstream of the transport path without transfer movement of the tube support members onto the transport path. Furthermore, the means for selectively increasing the relative height of the delivery path includes means for moving the crossover surface between a non-communicating position in which the crossover surface is out of communication with the delivery path for permitting the endless member to draw tube support members from the delivery path onto the transport path and a communicating position in which the crossover surface is in communication with the delivery path for preventing transfer movement of tube support members onto the transport path.

Preferably, the means forming the crossover surface includes an entry portion forming an entry crossover surface and an exit portion forming an exit crossover surface and the means for moving the crossover surface includes means for vertically moving the entry and exit portions in coordination with one another to simultaneous raised positions in which the entry crossover surface is above the endless member and upstream thereof and the exit portion is above the endless member and downstream thereof relative to the direction of transport of tube support members on the delivery path and simultaneous lowered positions in which the entry and exit crossover surfaces are below the endless member. Thus, the entry and exit portions, in their simultaneous raised positions, support tube support members for movement thereof above the endless member to thereby prevent transfer movement of the tube support members from the delivery path onto the transport path and the entry and exit crossover surfaces, in their simultaneous lowered positions, are spaced below the level of the base undersides of the tube support members and do not support tube support members to thereby permit tube support members at the transfer location to be drawn by the endless member from the delivery path onto the transport path.

According to one variation of the assembly, the assembly also includes a frame and wherein the entry portion and the exit portion are each pivotably mounted to the frame and the means for vertically moving the entry and exit portions includes means for pivoting the entry and exit portions between their simultaneous raised and lowered positions.

According to yet further preferred aspects of the assembly, the assembly includes means forming a post entry surface for supporting a tube support member thereon above the endless member at a location downstream of the upstream end of the transport path and means for moving the post entry surface between a non-engaged position in which the post entry surface is below the endless member and an engaged position in which the post entry surface is above the endless member for supporting a tube support member thereon which has been transferred from the delivery path onto the transport path. Also, the assembly includes means for sensing the presence of a tube support member at the upstream end of the transport path, the means for selectively increasing the relative height of the delivery path being operatively connected to the sensing means for selectively increasing the height of the delivery path or decreasing the height of the transport path at the transfer location in response to the sensing of the presence of the tube support member by the sensing means, whereby tube support members being transported along the delivery path in following relation to the sensed tube support member continue further on the delivery path and are not transferred onto the transport path.

Also, the assembly preferably includes delivery guide means associated with the crossover surface for preventing lateral movement of a tube support member from the crossover surface onto the transport path.

According to another variation of the assembly, the transport path means includes at least one endless member having a top run traveling in a direction laterally away from the transfer location and positioned for engaging the base undersides of tube support members to draw the tube support members from the delivery path onto the transport path and the means for selectively increasing the relative height of the delivery path includes means forming a crossover surface in communication with the delivery path for supporting tube support members above the endless member to thereby prevent engagement of tube support members by the endless member and means for selectively moving the endless member between a non-transfer position in which the endless member is spaced below the base undersides of the tube support members and does not operate to draw tube support members onto the transport path and a transfer position in which the top run of the endless member is disposed at least at the height of the crossover surface for transfer engagement of tube support members by the endless member to draw tube support members from the delivery path onto the transport path.

The present invention accordingly provides an assembly for transporting tube support members including means forming a delivery path for transport therealong of tube support members, means forming a transport path having an upstream end and a downstream end, the upstream end being positioned adjacent the delivery path at a transfer location and extending relative to the travel path of the tube support members on the delivery path for effecting transfer of tube support members from the delivery path into the transport path and means for selectively preventing the transfer of tube support members from the delivery path into the transport path.

BRIEF DESCRIPTION OF THE DRAWINGS

FIG. 5 is a perspective view of the means for selectively increasing the relative height of the delivery path of the transport assembly portion shown in FIG. 2;

FIG. 6 is a side elevational view, in partial vertical section, of the vertically moving means shown in FIG. 5 in the simultaneous raised positions of the entry and exit crossover surfaces;

FIG. 7 is a side elevational view, in partial vertical section, of the vertically moving means shown in FIG. 5 in the simultaneous lowered positions of the entry and exit crossover surfaces;

DETAILED DESCRIPTION OF THE PREFERRED EMBODIMENTS

Figure 1:
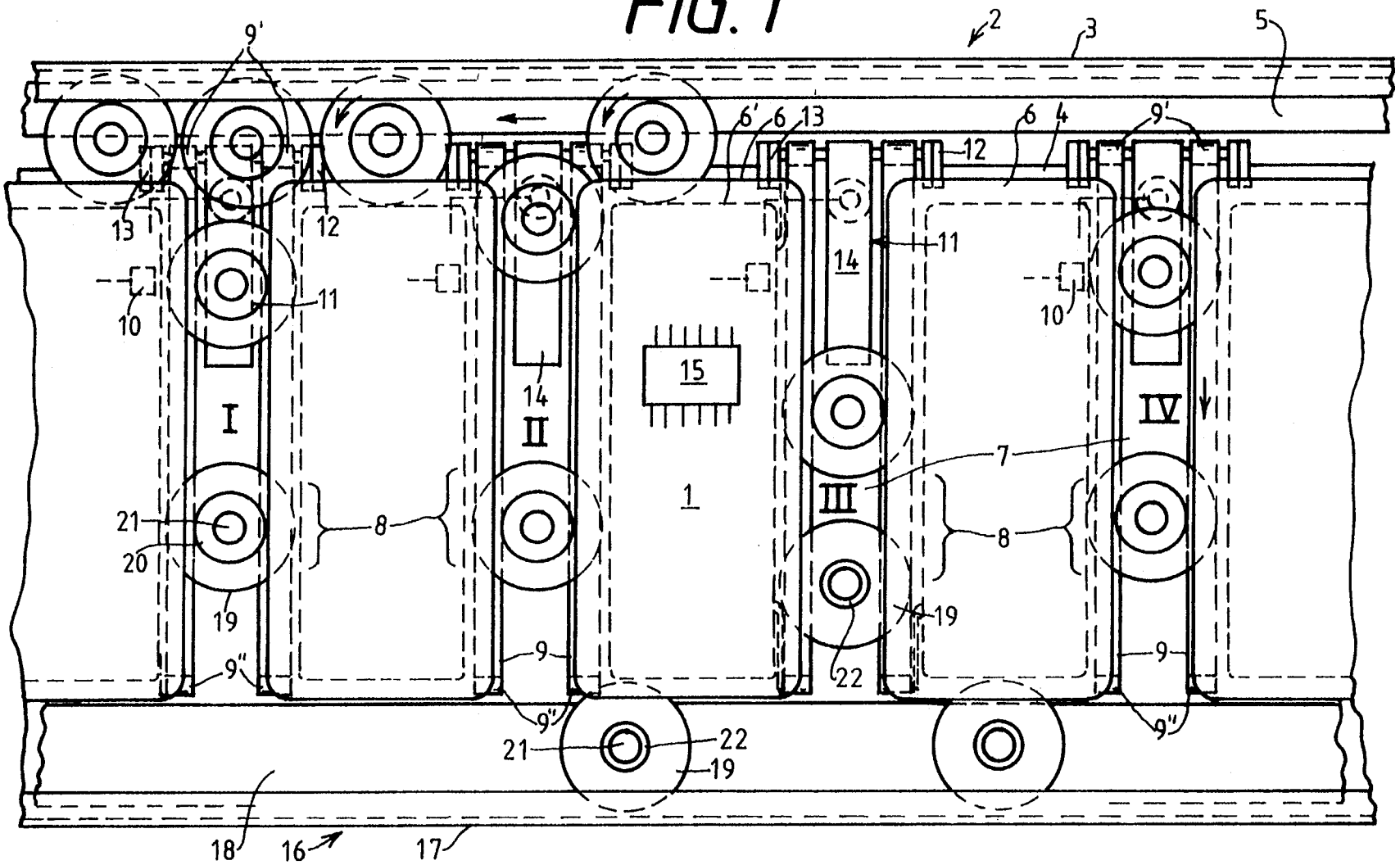
FIG. 1 is a schematic plan view of a portion of a textile winding machine incorporating one embodiment of the transport assembly of the present invention.
Figure 2:
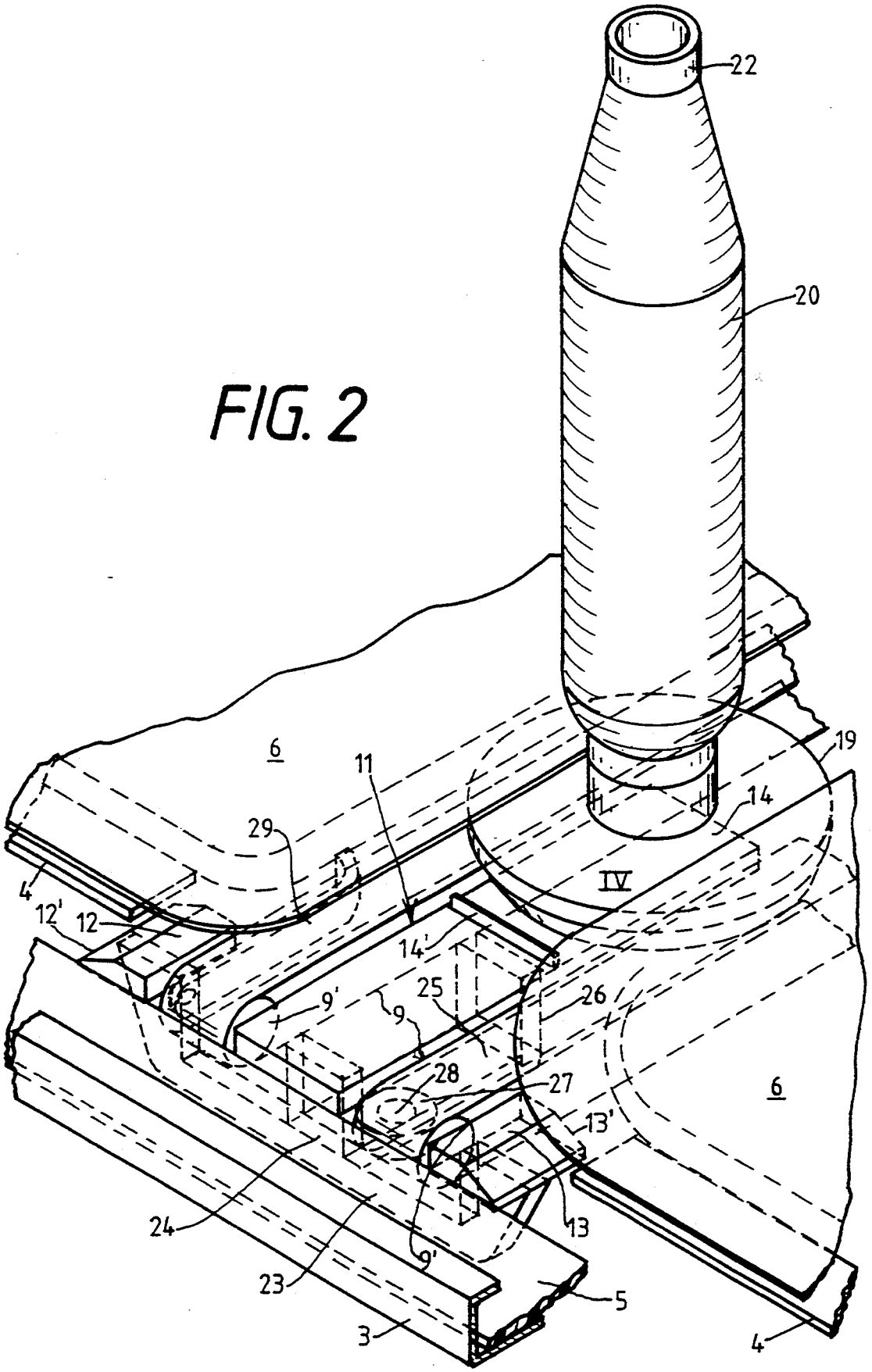
FIG. 2 is an enlarged perspective view of a portion of the textile winding machine and incorporated transport assembly shown in FIG. 1 and showing details of the transfer location and the means for selectively increasing the relative height of the delivery path.

As seen in FIGS. 1–7, one embodiment of the transport assembly of the present invention is operable to individually transport a plurality of textile yarn packages 20 and a plurality of tubes 22, each individually supported on a tube support member 19, between various locations on a textile winding machine 1. As seen in FIG. 1, each tube support member 19 is of the type having a cylindrical base and a support portion in the form of a post 21 coaxially mounted on the cylindrical base for receiving a textile yarn package 20 or a tube 22 inserted thereon to support the respective textile yarn package 20 or tube 22 in an upright disposition. Each package 20, as seen in FIG. 2, comprises yarn built on a tube 22.

The textile winding machine 1 includes a plurality of winding stations such as, for example, the winding stations 8 (four of which are designated I, II, III, and IV), shown in FIG. 1, at which winding stations yarn is unwound from the textile yarn packages 20 onto other yarn packages (not shown). As seen in FIG. 1, the transport assembly includes means forming a delivery path 2. The delivery path 2 delivers the tube support members 19 in a direction transverse to the winding stations 8 for further passage of the tube support members 19 into and through each winding station 8 via a plurality of further transport paths 7, each extending through a respective one of the winding stations 8. Thus, each tube support member 19 supporting a textile yarn package 20 thereon is automatically diverted onto a respective one of the transport paths 7, as described in more detail below, and subsequently positioned at an unwinding position at the respective winding station 8 for unwinding of the textile yarn package 20. Once the yarn has been unwound from the textile yarn package 20, only the tube 22 of the textile yarn package 20 remains (or some or all of the yarn remains on the tube 22 if the yarn unwinding operation has not successfully removed any or all of the yarn on the textile yarn package 20). Accordingly, upon the completion of a yarn unwinding operation, whether successful or not, the tube support members 19 supporting textile yarn packages 20 or tubes 22 which are completely empty or still have yarn thereon, are transported further along the transport paths 7 to a common discharge path 16, which transports the tube support members 19 to a further handling location. As seen in FIG. 1, the common discharge path 16 is formed by a C-shaped support frame 17 which supports one lateral side of an endless belt 18.

The textile yarn packages 20 are transported to each winding station 8 by the transport assembly of the present invention which includes, as seen in particular in FIG. 1, the means forming the delivery path 2 in the form of an endless belt 5 extending transversely to the winding stations 8 and supported, as seen in particular in FIGS. 1 and 2, on the lower flange of a C-shaped guide channel 3 extending along a respective lateral side of the endless belt.

As seen in FIG. 2, the lateral extent of the endless belt is greater than the lateral extent of the lower flange of the C-shaped guide channel 3 such that a portion of the endless belt laterally toward the winding stations 8 is not supported by the C-shaped guide channel 3. Additionally, as seen particularly in FIGS. 3 and 4, the C-shaped guide channel 3 includes a top flange which is disposed at a predetermined height above the endless belt, as measured transversely both to the direction of travel of the endless belt and to the lateral extent of the endless belt, sufficient to permit the cylindrical base of each tube support member 19 to travel under the top flange of the C-shaped guide channel 3. Further, the lower flange of the C-shaped guide channel 3 is inclined laterally downwardly in the direction toward the winding stations 8 such that each tube support member 19 being transported by the endless belt, as seen in FIG. 4, is tilted slightly toward the winding stations 8 during its transport by the endless belt.

To prevent each tube support member 19 from sliding laterally off the endless belt during its transport thereby due to the lateral inclination of the endless belt, a plurality of generally horizontal cover plates 6 extend between the winding stations 8. Each horizontal cover plate 6 includes a generally vertical wall segment 6', as seen in FIG. 3, extending parallel to the direction of travel of the endless belt and laterally spaced from the C-shaped guide channel 3 for guiding the tube support member 19 therebetween and preventing sliding movement of the tube support members 19 laterally beyond their supported position on the endless belt.

The horizontal cover plates 6, in addition to cooperating with the C-shaped guide channel 3 to guide the tube support members 19 during their transport along the delivery path 2, also cover moving parts of the winding stations 8 thereunder and provide protection against the entry and accumulation of debris or dust.

Figure 4:
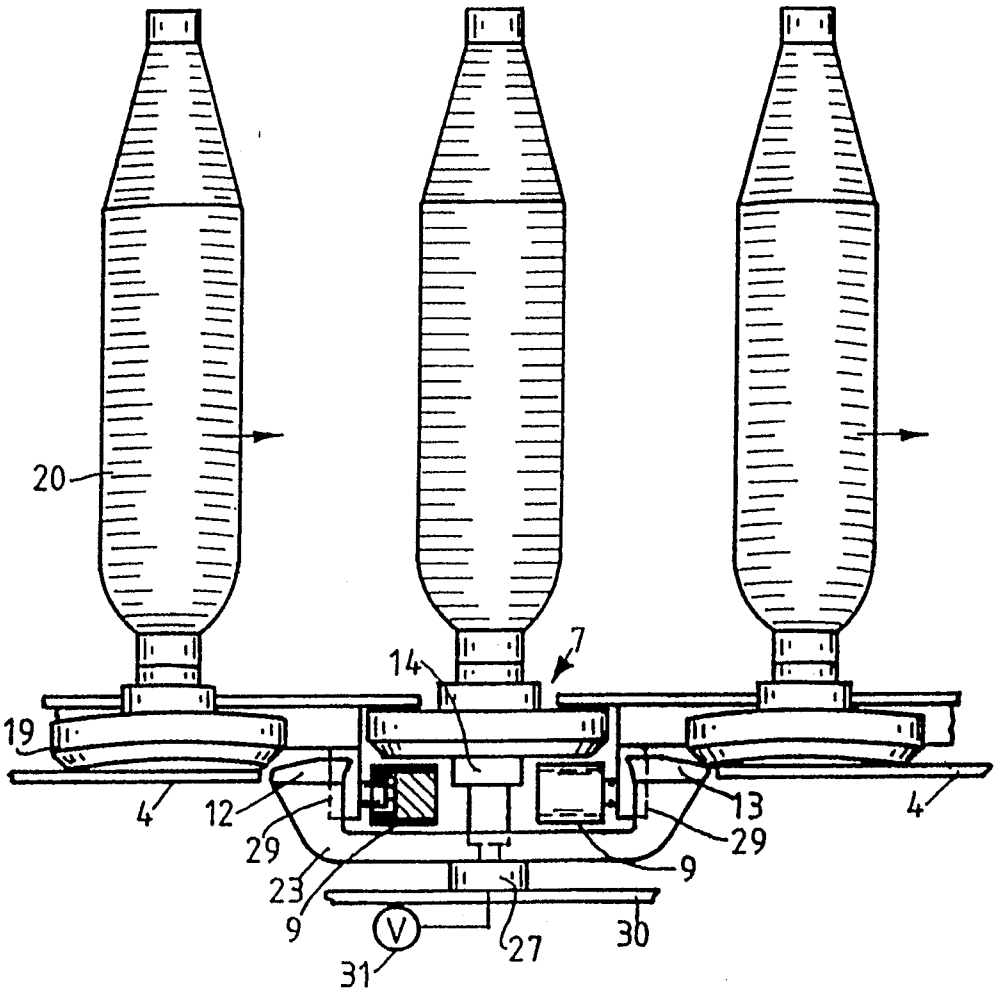
FIG. 4 is a rear plan view, in partial vertical section, of the transport assembly portion shown in FIG. 2.
Figure 3:
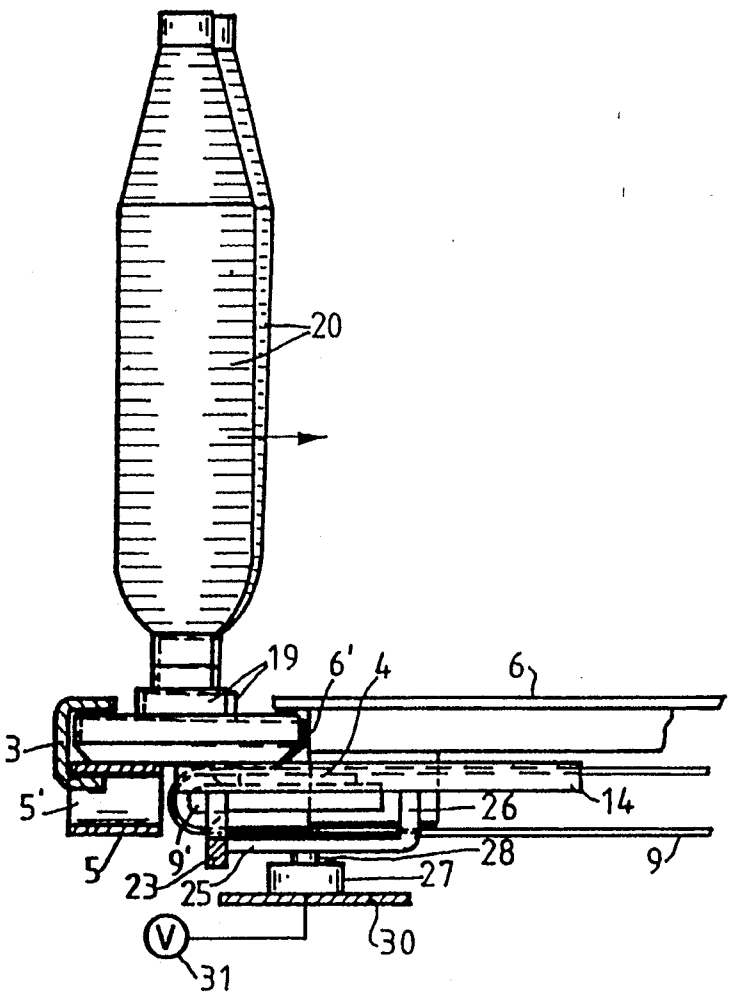
FIG. 3 is a side elevational view, in partial vertical section, of the transport assembly portion of the textile winding machine shown in FIG. 2.

Further support for the tube support members 19 being transported by the endless belt is provided by a plurality of support plates 4, as seen in FIGS. 2–4, which extend generally horizontally substantially at the same transverse level as the lower flange of the C-shaped guide channel 3 for supporting the undersides of the cylindrical bases of the tube support members 19 which extend laterally beyond the endless belt. The support plates 4, unlike the endless belt, do not move and are, therefore, stationary and, as a result of the movement of the endless belt relative to the stationary support plates 4, the tube support members 19, which are simultaneously supported on both the endless belt and the support plates 4, tend to roll along the plates 4 and thereby rotate about their axes in a direction of rotation which corresponds to the direction of travel of the endless belt. As seen in FIG. 1, if the endless belt travels in a direction from right to left, the tube support members 19 thereon tend to rotate in a counterclockwise direction as indicated by the arrows. Conversely, if the endless belt is driven in the opposite direction (left to right as seen in FIG. 1) the tube support members 19 thereon tend to rotate in a clockwise direction during their translatory movement by the endless belt.

Each transport path 7 is formed, as seen in FIG. 1 and 2, by a pair of spaced endless belts 9, each having an upstream end trained around a guide roller 9', as seen in FIG. 1, and a downstream end trained around a drive roller 9'', which is operatively connected to a conventional drive motor (not shown) for driving operation of the endless belt 9. Each guide roller 9' is rotatably mounted to a frame member 29 of the textile winding machine 1. The upstream end of each endless belt 9 of the transport path is disposed adjacent the respective lateral side of endless belt 5 of the delivery path toward the winding stations 8 and extends under the tube support members 19 being transported along the delivery path 2 for automatically diverting the tube support members 19 into the winding stations 8, in a manner described in more detail below. Each pair of the endless belts 9 which form the transport path 7 of each respective winding station 8 are disposed in spaced, parallel relation with their respective outer edges spaced a distance generally corresponding to the diameter of a tube support member 19 such that each tube support member 19 transported along a transport path 7 is supported by the pair of the endless belts 9. As seen in FIG. 1, the horizontal cover plates 6 of respective adjacent winding stations 8 partially overlie the cylindrical base of each tube support member 19 being transported along the transport path 7 and thereby cooperate with the pair of the endless belts 9 to stably transport the tube support members 19 through the winding stations 8. The spaced relation of each pair of the endless belts 9 permits, for example, a tilting mechanism of the type used for tilting a textile yarn package 20 during a yarn end engaging operation at a winding station to be extended into contact with a respective tube support member 19 supported at a yarn unwinding position, such as is disclosed in U.S. Pat. No. 5,056,726, which is incorporated by reference herein. Each endless member 9 is operatively connected to a control unit 15, which controls the driving operation of each endless member 9 in response to various information, including information received from sensing devices concerning the presence of a tube support member 19 at certain predetermined locations on the transport assembly.

With reference to FIGS. 2–4, further details of the cooperative interaction of the endless belts 9 of each transport path 7 with the endless belt of the delivery path are illustrated. As seen in FIG. 3, the guide roller 9' around which each endless belt 9 is trained is disposed laterally inwardly and transversely below the tube support members 19 as they are transported along the delivery path 2. While the exposed underside of the cylindrical base of each tube support member 19 is normally supported by a support plate 4 during transport of each tube support member 19 in the delivery path 2, the support plates 4 do not extend into the region of each transport path 7, as seen in FIG. 2; instead, as each tube support member 19 reaches a transport path 7, the respective closest one of the pair of the endless belts 9 of the transport path 7 engages the exposed underside of the cylindrical base of the tube support member 19 as it is transported beyond a support plate 4. Since the direction of travel of the top run of each endless belt 9 of the transport path is laterally away from the endless belt of the delivery path, the respective endless belt 9 of the transport path draws the tube support member 19 into the respective transport path 7 while, simultaneously, the endless belt of the delivery path continues to impart translatory motion to the tube support member 19 along the delivery path 2. Accordingly, the tube support member 19 is simultaneously drawn laterally away from the delivery path while the endless belt of the delivery path continues to translationally move the tube support member 19 and its translational movement eventually brings the tube support member 19 into engagement with the other respective endless belt 9 of the respective transport path 7, which thereupon also exerts a force on the tube support member 19 to draw the tube support member 19 into the respective transport path 7.

Once the pair of the endless belts 9 of the respective transport path 7 have fully drawn the tube support member 19 laterally off the endless belt, the further transport of the tube support member 19 is now completely provided by the pair of endless belts 9 and these endless belts 9 advance the tube support member 19 toward the yarn unwinding position of the respective winding station 8 through which the respective transport path 7 leads. If sufficient space remains in the respective transport path 7 upstream of the tube support member 19 drawn into the transport path 7, the next following tube support member 19 being transported on the delivery path 2 are likewise drawn into the respective transport path 7 as they reach the transfer location formed by the junction of the respective transport path 7 and the delivery path. Additionally, if the endless belt of the delivery path is operatively connected to a conventional reversible drive motor which is operable to selectively reverse the direction of travel of the endless belt, the tube support members 19 are drawn into the transport paths 7 in the same manner—i.e., the closest respective one of the pair of the endless belts 9 at initially engages the tube support member 19 to initiate the transfer movement of the tube support member 19 from the delivery path 2 onto the transport path 7.

As seen in FIG. 1, the several transport paths 7 operate independently of one another to draw in the tube support members 19 and transport the tube support members 19 to the yarn unwinding positions of the winding stations 8. The transport path 7 of the textile winding station II is, at the moment of operation illustrated in FIG. 1, drawing in a tube support member 19 from the delivery path 2.

The endless belts 9 of the delivery paths operate continuously such that the tube support members 19, which are transported in random manner at uneven time and distance intervals along the delivery path 2, are automatically drawn into the transport path 7 of those winding stations 8 having a reserve requirement for the textile yarn packages 20 or an immediate need of a textile yarn package 20 at its yarn unwinding position. However, for various reasons including the desirability of more accurate control of the feeding of the tube support members 19 into the transport paths 7 and the ability to deliver the tube support members 19 to only selected ones of the winding stations 8, it is desirable to selectively block or prevent the transfer of tube support members 19 into a transport path 7 and, for this reason, the transport assembly of the present invention provides a selective transfer blocking capability. This capability is provided by a means for selectively increasing the relative height of the delivery path 2 with respect to the transport paths 7 and, in one embodiment of the transport assembly, is in the form of a crossover device 11, as seen in FIGS. 1–7. In its engaged position, as explained in more detail below, the crossover device 11 temporarily communicates with the delivery path 2 to temporarily elevate a tube support member 19 at a transfer location to prevent engagement of the tube support member 19 by the endless belts 9 at the transfer location, whereupon the tube support member 19 is further transported along the delivery path 2 beyond the respective transfer location.

The crossover device 11 includes means for forming a crossover surface in the form of a first ramp 12, a second ramp 13, and an intermediate ramp 14 disposed between the first and second ramps 12,13. The ramps 12–14 together form a crossover surface which includes an entry portion which initially engages a tube support member 19 being transported on the delivery path 2 and an exit portion which supports the tube support member 19 as the tube support member 19 exits the crossover device 11 past the respective transfer location at which the crossover device 11 is temporarily operating.

As seen in FIG. 5, the first ramp 12 and the second ramp 13 are each supported on a respective arm of a crossover frame 23 and each ramp 12,13 includes a tapered surface 12',13', respectively, for facilitating the sliding movement of a tube support member 19 onto the crossover device 11, as discussed in more detail below. The intermediate ramp 14 is supported on a frame member 24 extending from the mid-point of the crossover frame 23 and on an arm 26 of a lift brace 25. The free end of a piston 28 is mounted to the mid-section of the lift brace 25 and, as seen in FIG. 6 and 7, the other end of the piston 28 is operatively connected to a cylinder 27 for selective extension and retraction of the piston 28 relative thereto. The cylinder 27 is operatively connected to a valve assembly 31 which supplies fluid to the cylinder 27 for extension and retraction of the piston 28. The valve assembly 31 is operatively connected to the control unit 15.

As seen in FIGS. 2–3, each crossover device 11 is disposed at a respective transfer location with its intermediate ramp 14 extending intermediate the pair of endless belts 9 which extend into the transfer location and each of the ramps 12,13 being disposed outward of a respective one of the endless belts 9. The crossover device 11 is disposed sufficiently laterally toward the respective winding station 8 and away from the endless belt of the delivery path that the ramps 12–14 can be freely raised and lowered past the endless belt without interference therewith.

Each crossover device 11 is additionally provided with means for preventing movement of a tube support member 19 into the delivery path toward the winding station in the form of a projection 14', as seen in FIG. 5, which extends upwardly from the surface of the intermediate ramp 14. The projection 14' is disposed at a distance from the delivery path to prevent tube support members from entering the transport path as they travel over the raised crossover device 11. The upward extent of the projection 14' is limited so as to be below the level of the pair of endless belts 9 when the crossover device 11 is in its lower, inactive position so that the projection 14' will not prevent passage of tube support members 19 therepast as a tube support member 19 is being diverted from the delivery path into and along the transport path toward the winding station. The lateral midsection of each intermediate ramp 14 laterally inward of the projection 14' toward the textile winding station forms a post entry surface for supporting a tube support member 19 thereon above the endless belts 9 at a location downstream of the upstream end of the respective transport path 7.

As seen in FIG. 1, a sensing device 10 is disposed adjacent each transport path 7 at a relatively short spacing from the upstream end thereof and is operatively connected to the control unit 15. Each sensing device 10 is operable to sense the presence of a tube support member 19 (or a textile yarn package 20 or a tube 22 supported thereon) at a position on the respective transport path 7 a short distance downstream of the transfer location at which the tube support members 19 are transferred into the transport path 7.

The operation of one embodiment of the transport assembly illustrated in FIGS. 1–7 in transporting the tube support members 19 to the winding stations 8, including the operation of the transport assembly in controlling the feed of the tube support members 19 to the winding stations 8, will now be described. The tube support members 19 are transported by the endless belt 5 along the delivery path 2 in the reversible movement described earlier in which the endless belt and the horizontal cover plates 6 cooperate together to produce rotation of the tube support members 19 while, simultaneously, the tube support members 19 are translationally moved by the endless belt sequentially to and through the transfer locations formed by the junction of each transport path 7 and the delivery path 2. At each transport path 7 into which a tube support member 19 is to be delivered, the respective crossover device 11 at the transport path 7 is disposed in a non-communicating or inactive position in which the crossover surface formed by the ramps 12–14 thereof are out of interference with the tube support members 19 being transported on the delivery path 2. Each such crossover device 11 is disposed in its non-communicating position by control of the valve assembly 31 by the control unit 15 to effect lowering of the crossover device 11 from a raised position, as seen in FIG. 6, to a lowered position, as seen in FIG. 7. In its lowered position as seen in FIG. 7, the top surfaces of the ramps 12–14 forming a crossover surface are transversely below the surface of the top run of the endless belt and the support plate 4 and, accordingly, these ramps of the crossover device 11 do not engage the tube support members 19 being transported thereabove along the delivery path 2 and, therefore, the pair of endless belts 9 in the transport path will engage and transport the tube support member into the transport path toward the winding station.

On the other hand, if it is desired to block the transfer of the next oncoming tube support member 19 into a particular transport path 7, the respective crossover device 11 associated with the transport path 7 is raised from its lowered position shown in FIG. 7 to its raised or active position shown in FIG. 6 via appropriate supply of fluid to the cylinder 27 by the valve assembly 31. In its raised, communicating position, the crossover device 11 is disposed for automatically engaging the next oncoming tube support member 19 being transported along the delivery path 2. In accordance with the respective direction of travel of the endless belt such as, for example, a direction as shown by the arrow in FIG. 1 from right to left, a respective one of the ramps 12,13 of the crossover device 11 will initially engage the oncoming tube support member 19. For example, in the configuration illustrated in FIG. 1, the ramp 12 of each crossover device 11 in its raised, communicating position will initially engage the oncoming tube support members 19 as they are translationally moved along the delivery path 2. As seen in FIG. 2, the tapered surface 12' of the first ramp 12, whose lower end is generally transversely aligned (e.g., at the same height) as the top run of the endless belt and the top surface of the support plates 4, initially engages the cylindrical base of the next oncoming tube support member 19 approaching the transfer location and guides the tube support member 19 upward as the endless belt continues to translationally move the tube support member 19. Since a portion of the cylindrical base underside of the tube support member 19 is still engaged by the moving endless belt of the delivery path, the tube support member 19 is propelled up the tapered surface 12' of the first ramp 12, across the intermediate ramp 14 with the projection 14' preventing entry of the tube support member into the transport path, and onto the second ramp 13 and down the tapered surface 13' thereof. As the tube support member 19 is moved beyond the tapered surface 13', it is again engaged by a support plate 4 located downstream of the transfer location on the delivery path 2 and the tube support member 19 is subsequently further transported along the delivery path 2 toward the next transfer location. Accordingly, in its raised, communicating position, each crossover device 11 acts in coordination with the endless belt to effect transport of a tube support member 19 into and through a transfer location without transfer movement of the tube support member 19 into the respective transport path 7.

As seen in FIGS. 3 and 4, due to the overall slight lateral incline of each tube support member 19 as it is transported along the delivery path 2, a tube support member 19 traveling on the crossover surface of a crossover device 11 will tend to slide laterally toward the textile winding stations. However, the projection 14' engages the circumferential edge of the cylindrical base of the tube support member 19 to maintain its lateral position during movement by the moving endless belt of the delivery path. The overall slight lateral inclination of each tube support member 19 may be accomplished, for example, disposing the endless belt of the delivery path at an inclination or by disposing the bottom flange of the C-shaped guide channel 3 and the top surface of the support plate 4 at generally the same height and relying on the additional thickness provided by the top run of the endless belt to incline the tube support members 19 laterally toward the textile winding machine (and, thus, toward the entrance of each transport path 7).

Although not in scale, the view of the one embodiment of the transport assembly shown in FIG. 4 shows that the relative unsupported gaps between the second ramps 13 and the intermediate ramp 14 is relatively short such that a relatively smooth passage of each tube support member 19 along each crossover surface is assured.

With reference to FIG. 1, the controlled movement of the crossover devices 11 between their lower, non-communicating positions and their raised, communicating positions will now be described. At the moment of the transport operation illustrated in FIG. 1, the transport path 7 of the textile winding station II is a textile yarn package 20 at the yarn unwinding position as yarn is being unwound from the textile yarn package 20 and, additionally, another tube support member 19 supporting a textile yarn package 20 is just completing its transfer movement from the delivery path 2 onto the transport path 7 at the upstream end thereof. The respective crossover device 11 of the transport path 7 is in its lower, non-communicating position, which permits the tube support member 19 to enter the transport path 7. As the tube support member 19 which has just entered the transport path 7 is further transported by the pair of the endless belts 9 of the transport path 7, the tube support member 19 passes the respective sensing device 10 of the transport path 7, such as can be seen in the transport path 7 of the textile winding station I at which a tube support member 19 is passing the sensing device 10 thereof. The sensing device 10 signals the presence of the tube support member 19 to the control unit 15, which controls the respective crossover device 11 to move from its lowered, non-communicating position to its raised, communicating position. This raising movement of the respective crossover device 11 is controlled to occur relatively rapidly so that the respective crossover device 11 is raised into its raised, communicating position before the respective tube support member 19 sensed by the sensing device 10 has been advanced so far along the transport path 7 that it is beyond the crossover device 11. Instead, as the respective crossover device 11 is raised, the post entry surface of the projection 14' engages the cylindrical base underside of the sensed tube support member 19 and lifts the tube support member 19 transversely upwardly out of engagement with the pair of the endless belts 9 which are advancing the tube support member 19 along the transport path 7. Moreover, as the tube support member 19 now supported on the post entry surface is raised as the respective crossover device 11 completes its raising movement, laterally opposite portions of the cylindrical base of the tube support member 19 are pressed against the underside of the respective pair of the horizontal cover plates 6 which cooperate with the pair of the endless belts 9 in guiding the tube support members 19 along the transport path 7 and this resulting compressive action of the cylindrical base of the tube support member 19 between the post entry surface and the pair of the horizontal cover plates 6 acts to stabilize the tube support member 19 in its temporary stationary position on the post entry surface.

The disposition of the respective crossover device 11 into its raised, communicating position also ensures that the next oncoming tube support members 19 arriving at the transfer location and traveling over the crossover surface formed by the respective crossover device 11 and are not, therefore, transferred into the transport path 7.

Once the textile yarn package 20 supported at the winding station 8 has been completely unwound so that only a tube 22 remains supported on the tube support member 19 (or once the yarn unwinding operation has ended even if some or all of the yarn of the textile yarn package 20 still remains), the tube support member 19 is further advanced to the common discharge path 16 and, in conjunction with this release of the tube support member 19 at the winding station 8, the control unit 15 controls the respective crossover device 11 to move from its raised, communicating position to its lowered, non-communicating position. For example, as seen in FIG. 1 at the textile winding station III, the tube support member 19 supported on the post entry surface of the respective crossover device 11 is lowered into engagement again with the pair of the endless belts 9 as the respective crossover device 11 completes its lowering movement and the pair of the endless belts 9 advance the previously retained tube support member 19 toward the winding station 8 of the textile winding station. Additionally, since the respective crossover device 11 has now again been disposed in its lowered, non-communicating position, the next oncoming tube support member 19 being transported along the delivery path 2 is automatically transferred by the drawing-in action of the pair of the endless belts 9 from the delivery path 2 into the transport path 7. After the next oncoming tube support member 19 on the delivery path 2 has completed its transfer movement into the transport path 7, the sensing device 10 senses the presence of the tube support member 19 and the raising movement of the respective crossover device 11 is again initiated by the control unit 15, as described earlier.

Since the crossover surface of each crossover device 11, in conjunction with its projection 14', prevents the transfer movement of the oncoming tube support members 19 into the respective transport path 7, no contact occurs between the oncoming tube support members 19 and the respective tube support members 19 in the transport path 7. Accordingly, the transport assembly of the present invention eliminates the necessity of dimensioning the transport paths 7 of a prescribed length to ensure that accumulation of a predetermined number of the tube support members 19 therein will position the last one of the accumulated tube support members 19 to engage the oncoming tube support members 19 on the delivery path 2 and prevent entry thereof into the transport path 7.

Figure 8:
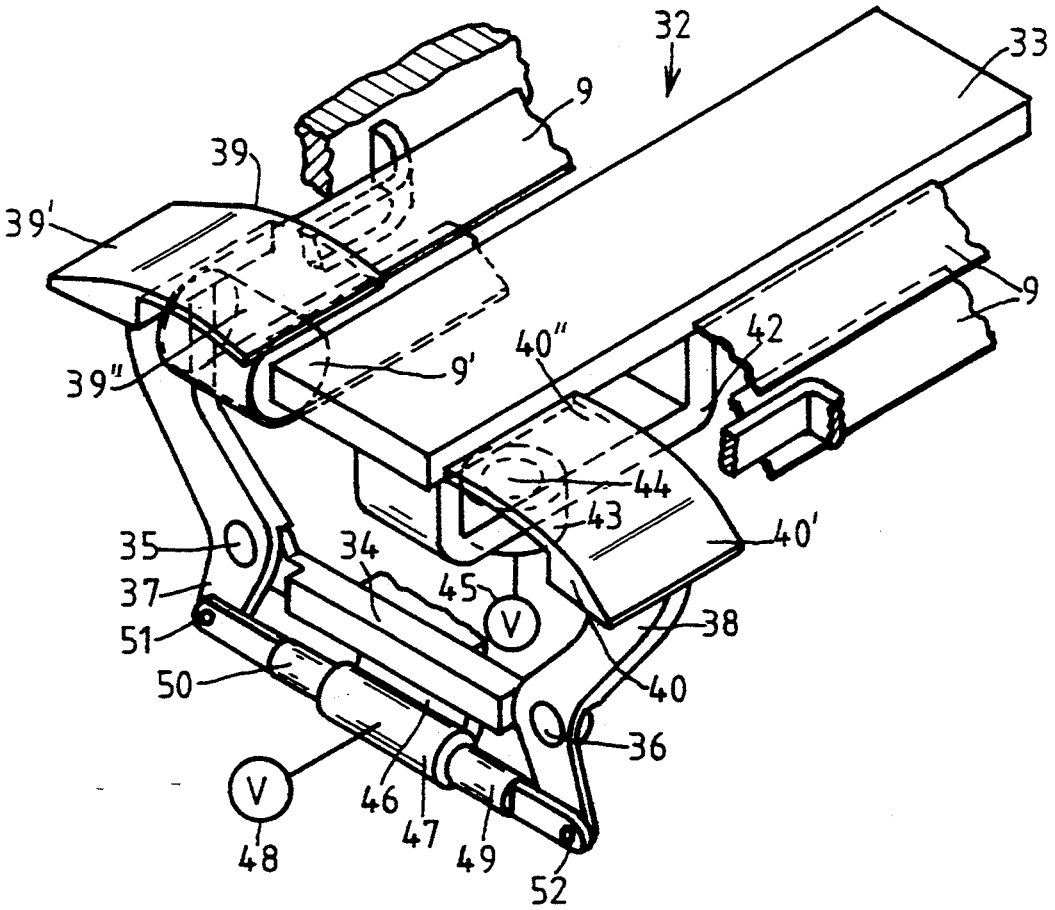
FIG. 8 is a perspective view of the means for selectively increasing the relative height of the delivery path of another embodiment of the transport assembly shown in FIG. 1.

In FIG. 8, another embodiment of the transport assembly of the present invention is illustrated. This embodiment of the transport assembly is identical in structure and operation to the embodiment of the transport assembly illustrated with respect to FIGS. 1–7 except that, in lieu of the crossover devices 11, this embodiment illustrated in FIG. 8 includes a transfer blocking device 32. The transfer blocking device 32 includes a first ramp 39, a second ramp 40, and an intermediate ramp 33. The first ramp 39 includes a tapered entry portion 29' and a belt covering portion 39''. The second ramp 40 includes a tapered entry portion 40' and a belt covering portion 40''. The first ramp 39 is fixedly connected to one end of a pivot arm 37 which is pivotably connected by a pivot 35 to one end of a frame crossarm 34, which is mounted to the frame of the textile winding machine. The free end of a piston 50 is pivotably mounted to the other end of the pivot arm 37 and the piston 50 is selectively extendable from, and retractable into, a cylinder 47, which is fixedly mounted to the frame crossarm 34. The cylinder 47 is operatively connected to a valve 48, which is operatively connected to the control unit 15, for controlling the supply of fluid into and out of the cylinder 47.

The second ramp 40 is mounted to one end of a pivot arm 38, which is pivotably connected via a cylinder 47 to the frame crossarm 34. The free end of a piston 49 is pivotably connected via a pivot 52 to the other end of the pivot arm 38. The piston 49 is selectively extendable from, and retractable into, the cylinder 47.

The intermediate ramp 33 is mounted to the ends of a U-shaped bracket 42, which is mounted at the mid-point of its base portion to the free end of a piston 44. The piston 44 is selectively extendable from, and retractable into, a cylinder 43, which is operatively connected to a valve 45. The valve 45 is operatively connected to the control unit 15 for controlled supply of fluid to the cylinder 43 to effect extension and retraction of the piston 44 to thereby raise and lower the intermediate ramp 33. The arrangement of the independently operable cylinders 46,43 for raising and lowering the ramps 39,40 and the intermediate ramp 33, respectively, bring certain advantages to the operation of the transfer blocking device 32. For example, the intermediate ramp 33, which operates similar to the intermediate ramp 14 of a crossover device 11 described with respect to the embodiment illustrated in FIGS. 1–7, raises a tube support member 19 into compressive engagement with the horizontal cover plates 6 along the side of the transport path 7. Depending upon the thickness of the intermediate ramp 33, the intermediate ramp 33 can be raised to a greater or lesser extent than the ramps 39,40. Additionally, the ability to separately raise and lower the intermediate ramp 33 enables the intermediate ramp 33 to be raised to such an extent that a tube support member 19 supported thereon can be sufficiently stably compressed between the intermediate ramp 33 and the pair of the horizontal cover plates 6 such that the tube support member 19 itself engages oncoming tube support members 19 on the delivery path 2 and prevents their entry into the transport path 7.

The embodiment of the transport assembly illustrated in FIG. 8 operates as follows. The tube support members 19 are transported along the delivery path 2 by the movement of the endless belt 5 and, as each tube support member 19 reaches a transport path 7 of a respective textile winding station, the tube support member 19 is automatically drawn into the transport path 7 by the action of the pair of the endless belts 9 thereat. If it is desired to prevent the transfer movement of the tube support members 19 into a respective transport path 7 such as, for example, if a tube support member 19 has already been admitted into the transport path 7 into a reserve position such as discussed previously with respect to the transport path 7 of the textile winding station I, the transfer blocking device 32 is operated to prevent such transfer movement while allowing the endless belt to continue to advance the tube support members 19 along the delivery path 2.

Normally, the transfer blocking device 32 at each respective transfer location is in a lowered, non-communicating position achieved by actuation of the valve 48 to effect retraction of each of the pistons 49,50, which, in turn, effects pivoting of the pivot arms 38,37, respectively, about their respective pivots 36,35. During this pivoting movement, the pivot arm 37 pivots counterclockwise about the pivot 35, as seen in FIG. 8, and the pivot arm 38 pivots clockwise about the pivot 36. Due to this pivoting movement, the belt covering portion 39'' and the belt covering portion 40'' each move laterally outward of the respective one of the endless belts 9 with which it is in overlying relationship and the pivoting of the pivot arms 37,38 is of a magnitude sufficient to effect movement of the first ramp 39 and the second ramp 40 to such an extent that the topmost portion of each ramp is transversely below the travel plane of the cylindrical base undersides of the tube support members 19 as they are transported along the delivery path 2, whereby the first ramp 39 and the second ramp 40 do not engage or otherwise interfere with the movement of the tube support members 19. Accordingly, the pair of the endless belts 9 of the respective transport path 7 at which the respective transfer blocking device 32 is in its lowered, non-communicating position operate to automatically engage the exposed portion of the cylindrical base underside of the oncoming tube support members 19 to thereby automatically draw the tube support members 19 into the transport path 7. Also, in coordination with the pivoting movement of first ramp 39 and second ramp 40 to their lowered, non-communicating positions, the control unit 15 controls the valve 45 to effect lowering of the intermediate ramp 33.

To dispose the transfer blocking device 32 in its raised, communicating position, the control unit 15 controls the valve 48 to effect extension of the pistons 49,50. The extension of the piston 49 effects pivoting of the pivot arm 38 in a counterclockwise manner about the pivot 36 and this pivoting movement swings the belt covering portion 40'' into a position in which it overlies the upstream end of one of the pair of the endless belts 9 of the respective transport path 7. At the same time, the extension of the piston 50 effects pivoting of the pivot arm 37 in a clockwise manner about the pivot 35 and this pivoting movement effects movement of the belt covering portion 39'' into overlying relationship with the upstream end of the other of the pair of the endless belts 9.

In coordination with the pivoting of the pivot arm 37 and the pivot arm 38, the control unit 15 controls the valve 45 to supply fluid to the cylinder 43 to thereby raise the intermediate ramp 33 to a position in which its top surface cooperates with the first ramp 39 and the second ramp 40 to engage the cylindrical base undersides of the tube support members 19 as they are transported along the delivery path 2. Depending upon the direction of travel of the endless belt 5, each tube support member 19 entering the transfer location contacts either the tapered entry portion 39' or the tapered entry portion 40' and slides along the first ramp 39 or the second ramp 40, respectively, across the top surface of the intermediate ramp 33, and then along the other one of the first ramp 39 or the second ramp 40. Since both of the endless belts 9 of the respective transport path 7 are covered by the first ramp 39 and the second ramp 40, neither of the endless belts 9 engage the tube support members 19 as they travel across the first ramp 39, the intermediate ramp 33, and the second ramp 40 and, accordingly, the tube support members 19 continue further along the delivery path 2 without being diverted into their respective transport path 7.

Figure 9:
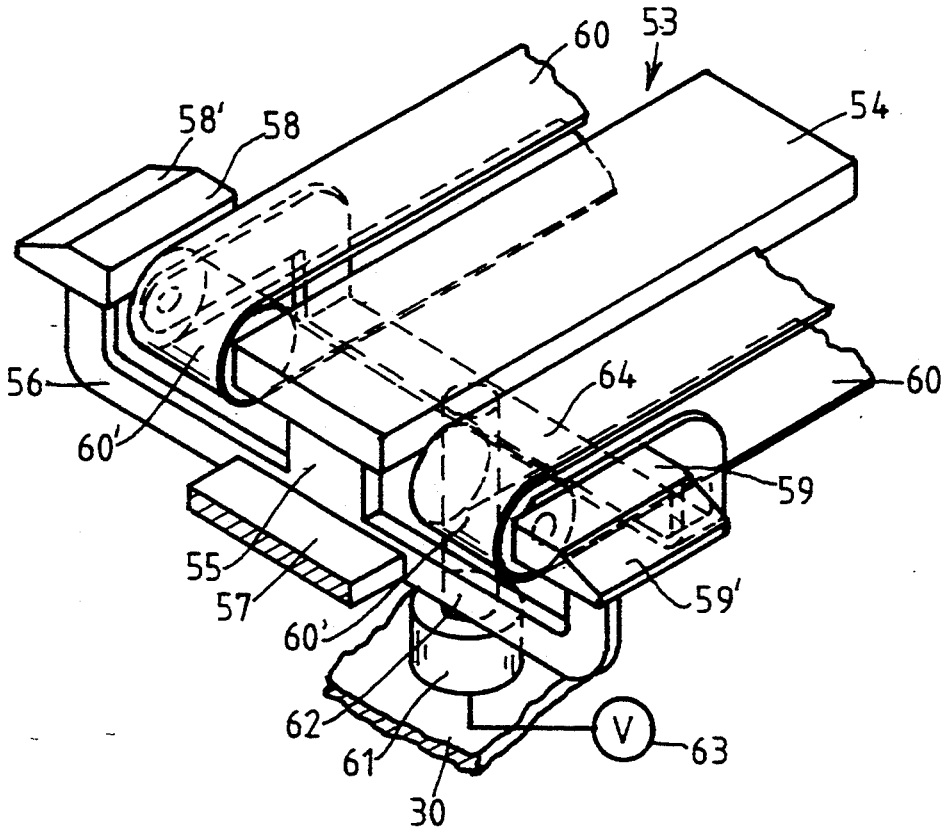
FIG. 9 is a perspective view of the means for selectively increasing the relative height of the delivery path of a further embodiment of the transport assembly shown in FIG. 1.

In FIG. 9, a further embodiment of the transport assembly of the present invention is illustrated and this embodiment is identical in structure and operation to the one embodiment of the transport assembly illustrated with respect to FIGS. 1–7 except that, in lieu of the crossover devices 11, the further embodiment of the transport assembly illustrated in FIG. 9 includes a transfer blocking device 53.

The transfer blocking device 53 includes a first ramp 58 and a second ramp 59, each having a tapered entry surface 58',59', respectively. The transfer blocking device 53 also includes an intermediate ramp 54 which extends laterally between a pair of endless belts 60. The endless belts 60 are each trained, at their upstream end, around a guide roller 60' and these endless belts are identical in structure and operation to the endless belts 9 described with respect to FIGS. 1–7.

The first ramp 58 is mounted to one end of a support bracket 56 which is fixedly mounted to a frame 57 of the textile winding machine. The second ramp 59 is also fixedly mounted to the support bracket 56 and the intermediate ramp 54 is fixedly mounted to the support bracket 56 on an intermediate arm 55 intermediately between the first ramp 58 and the second ramp 59. Thus, in contrast to the ramps 12,13,14 described with respect to the one embodiment illustrated in FIGS. 1–7, the ramps 58,54,59 of the further embodiment illustrated in FIG. 9 are not transversely movable but are, instead, fixedly mounted to a frame of the textile winding machine. However, the transfer blocking device 53 includes an arrangement for selectively increasing the relative height of the endless belts 60 and endless belt 5 of the delivery path in the form of a vertical movement device comprising a bracket 64 having a pair of opposed free ends. The guide roller 60' of each of the endless belts 60 is pivotably mounted to a respective one of the free ends of the bracket 64. The bracket 64 is fixedly mounted at its mid-point to the free end of a piston 62 which is selectively extendable from, and retractable into, a cylinder 61 mounted on a frame member 30 of the textile winding machine. The cylinder 61 is operatively connected to a valve 63 which is operatively connected to the control unit 51, which controls the operation of the valve 63 to supply fluid to the cylinder 61 and thereby effect raising and lowering of the bracket 64.

The vertical moving device is movable between a lowered position in which the bracket 64 is lowered to a position at which the upstream ends of the endless belts 60 are supported beneath the surfaces of the ramp 58,54,59 so that the tube support members 19 being transported along the delivery path 2 are not engaged by the endless belts 60 and drawn into the transport path 7 but, instead, are slidingly moved over the ramps 58,54,59. The vertical moving device is raised through selective supply of fluid to the cylinder 61 from its lowered position to a raised position at which the top run of the endless belts 60 are supported above the surfaces of the ramps 58,54,59. Accordingly, when the vertical moving device is in its raised position, the endless belts 60 are operable to engage the cylindrical base undersides of the tube support members 19 as they enter the transfer location formed by the respective transport path 7 and the delivery path 2. The endless belts 60 engage the cylindrical base undersides of the tube support members 19 and automatically draw them into the transport path 7.

Although the transport assembly of the present invention has been described with respect to various embodiments, it is not intended that the present invention be limited in scope to the specific details of the disclosed embodiments. For example, the present invention also contemplates that the operation of the means for selectively increasing the relative height of the delivery path with respect to the transport path may be accomplished without the use of the sensing devices 10. Instead, the transfer of the tube support members 19 from the delivery path 2 into the transport paths 7 may be controlled by the control unit 15 in response to signals received from the textile winding stations themselves indicating that new textile yarn packages 20 are needed after, for example, the completion of the unwinding of other textile yarn packages 20.

Additionally, the present invention contemplates that the entry and exit portions of each crossover device 11 may be configured as desired in correspondence with the direction of travel of the endless belt 5. While the endless belt 5 disclosed with respect to the various embodiments herein is of the type which cyclically or randomly reverses its direction of travel, the transport assembly of the present invention is equally suited for use with a delivery path endless belt which travels in only a single direction. In this situation, only the entry portion of the crossover or blocking devices need be provided with a tapered surface for facilitating the movement of the tube support members 19 onto the crossover or blocking devices 11 while the exit portion need not have a tapered surface.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An assembly for transporting tube support members, each tube support member having a base and a support portion thereon for supporting a textile tube in a generally upright disposition for transport and handling of the textile tube independent of other textile tubes, comprising:

means forming a delivery path for transport therealong of tube support members;

means forming a transport path extending transversely from said delivery path at a transfer location for receiving tube support members from the delivery path, the transport path means and the delivery path means being operable in coordination with one another to transfer tube support members from the delivery path to the transport path at the transfer location when tube support members arriving thereat are supported on the delivery path at a predetermined height relative to the transport path; and means for selectively increasing the relative height of the delivery path at the transfer location such that tube support members arriving at the transfer location on the delivery path continue along the delivery path without transfer onto the transport path.

2. An assembly for transporting tube support members according to claim 1 wherein an upstream end of the transport path extends to one lateral side of the delivery path, the delivery path means supports tube support members at the transfer location with a portion of the underside of the base of each tube support member exposed toward the one lateral side of the delivery path, and the delivery path means supports tube support members arriving at the transfer location at a height relative to the height of the transport path such that the base underside of the tube support members are engaged by the transport path means and drawn thereonto and the means for selectively increasing the relative height of the delivery path includes means for selectively raising the delivery path or lowering the transport path at the transfer location to prevent engagement of the base underside of tube support members by the transport path.

3. An assembly for transporting tube support members to claim 2 wherein the transport path means includes at least one endless member having a top run traveling in a direction laterally away from the transfer location and positioned for engaging the base undersides of tube support members to thereby draw the tube support members from the delivery path onto the transport path and the means for selectively increasing the relative height of the delivery path includes means forming a cross-over surface in communication with the delivery path for supporting tube support members above the endless member to thereby allow travel of the tube support members on the delivery path downstream of the transport path without transfer movement of the tube support members onto the transport path and means for moving the crossover surface between a non-communicating position in which the crossover surface is out of communication with the delivery path for permitting the endless member to draw tube support members from the delivery path onto the transport path and a communicating position in which the crossover surface is in communication with the delivery path for preventing transfer movement of tube support members onto the transport path.

4. An assembly for transporting tube support members according to claim 3 wherein the means forming the crossover surface includes an entry portion forming an entry crossover surface and an exit portion forming an exit crossover surface and the means for moving the crossover surface includes means for vertically moving the entry and exit portions in coordination with one another to simultaneous raised positions in which the entry crossover surface is above the endless member and upstream thereof and the exit portion is above the endless member and downstream thereof relative to the direction of transport of tube support members on the delivery path and simultaneous lowered positions in which the entry and exit crossover surfaces are below the endless member, whereby the entry and exit portions, in their simultaneous raised positions, support tube support members for movement thereof above the endless member to thereby prevent transfer movement of the tube support members from the delivery path onto the transport path and the entry and exit crossover surfaces, in their simultaneous lowered positions, are spaced below the level of the base undersides of the tube support members and do not support tube support members to thereby permit tube support members at the transfer location to be drawn by the endless member from the delivery path onto the transport path.

5. An assembly for transporting tube support members according to claim 4 and further comprising a frame and wherein the entry portion and the exit portion are each pivotably mounted to the frame and the means for vertically moving the entry and exit portions includes means for pivoting the entry and exit portions between their simultaneous raised and lowered positions.

6. An assembly for transporting tube support members according to claim 3 and further comprising means forming a post entry surface for supporting a tube support member thereon above the endless member at a location downstream of the upstream end of the transport path and means for moving the post entry surface between a non-engaged position in which the post entry surface is below the endless member and an engaged position in which the post entry surface is above the endless member for supporting a tube support member thereon which has been transferred from the delivery path onto the transport path.

7. An assembly for transporting tube support members according to claim 2 and further comprising means for sensing the presence of a tube support member at the upstream end of the transport path, the means for selectively increasing the relative height of the delivery path being operatively connected to the sensing means for selectively increasing the height of the delivery path or decreasing the height of the transport path at the transfer location in response to the sensing of the presence of the tube support member by the sensing means, whereby tube support members being transported along the delivery path in following relation to the sensed tube support member continue further on the delivery path and are not transferred onto the transport path.

8. An assembly for transporting tube support members according to claim 3 and further comprising delivery guide means associated with the crossover surface for preventing lateral movement of a tube support member from the crossover surface onto the transport path.

9. An assembly for transporting tube support members according to claim 2 wherein the transport path means includes at least one endless member having a top run traveling in a direction laterally away from the transfer location and positioned for engaging the base undersides of tube support members to draw the tube support members from the delivery path onto the transport path, the means for selectively increasing the relative height of the delivery path includes means forming a crossover surface in communication with the delivery path for supporting tube support members above the endless member to thereby prevent engagement of tube support members by the endless member and means for selectively moving the endless member between a non-transfer position in which the endless member is spaced below the base undersides of the tube support members and does not operate to draw tube support members onto the transport path and a transfer position in which the top run of the endless member is disposed at least at the height of the crossover surface for transfer engagement of tube support members by the endless member to draw tube support members from the delivery path onto the transport path.

10. An assembly for transporting tube support members according to claim 9 wherein the vertically moving means includes a frame on which the entry and exit portions are mounted and means for moving the frame to effect movement of the entry and exit portions between their simultaneous raised and lowered positions.

11. An assembly for transporting tube support members, each tube support member having a base and a support portion thereon for supporting a textile tube in a generally upright disposition for transport and handling of the textile tube independent of other textile tubes, comprising:

means forming a delivery path for transport therealong of the support members;

means forming a transport path having an upstream end and a downstream end, the upstream end being positioned adjacent the delivery path at a transfer location and extending relative to the travel path of the tube support members on the delivery path for effecting transfer of tube support members from the delivery path into the transport path; and means for selectively preventing the transfer of tube support members from the delivery path into the transport path as said support members are transported along said delivery path past said transport path.

* * * * *